United States Patent [19]

Fleck

[11] Patent Number: 4,812,737

[45] Date of Patent: Mar. 14, 1989

[54] VOLTAGE REGULATOR FOR SOLAR CELL ARRAYS

[75] Inventor: Gerald W. Fleck, Long Beach, Calif.

[73] Assignee: TRW Inc., Redondo Beach, Calif.

[21] Appl. No.: 72,065

[22] Filed: Jul. 10, 1987

[51] Int. Cl.[4] ..... G05F 1/67

[52] U.S. Cl. ..... 323/271; 323/283; 323/906

[58] Field of Search ..... 323/299, 225, 906, 283, 323/268; 322/2 R; 320/2, 56

[56] References Cited

U.S. PATENT DOCUMENTS

| | | | |
|---|---|---|---|
| 4,079,445 | 3/1978 | Hufnagel | 323/906 |
| 4,175,249 | 11/1979 | Gruber | 323/906 |
| 4,476,520 | 10/1984 | Gallemore | 323/906 |
| 4,706,010 | 11/1987 | Callen et al. | 323/906 |

*Primary Examiner*—William H. Beha, Jr.

*Attorney, Agent, or Firm*—James M. Steinberger; Sol L. Goldstein

[57] ABSTRACT

An improved switch controller and related method for regulating the supply voltage of a solar cell array. The switch controller includes at least two shift registers, with additional shift registers concatenated as required by the size of the array. Each of the shift registers controls segments of the solar cell array having increasingly larger outputs, with the first shift register providing fine resolution control of the supply voltage and the second and additional shift registers providing increasingly-coarser resolution control of the supply voltage. The improved switch controller provides improved switching characteristics for the regulation of the supply voltage of a solar cell array.

24 Claims, 3 Drawing Sheets

FIG. 2A
PRIOR ART
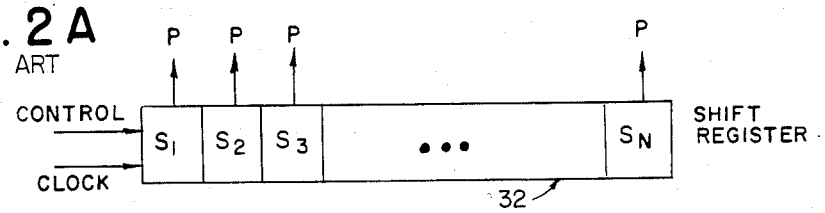
FIG. 2B
PRIOR ART
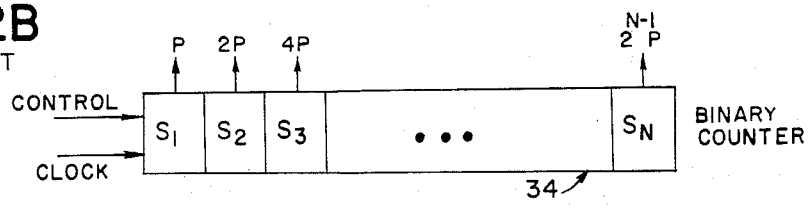
FIG. 2C
PRIOR ART
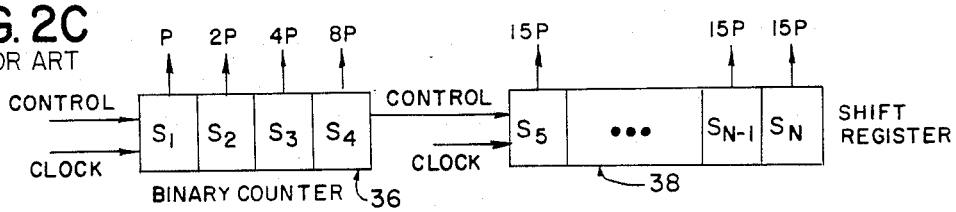
FIG. 2D
PRIOR ART
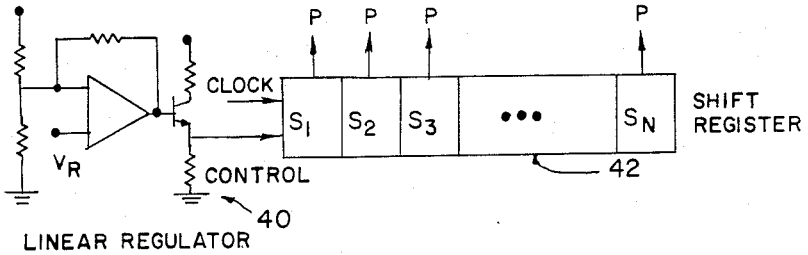
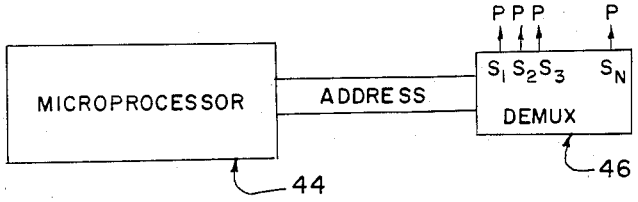
FIG. 2E
PRIOR ART

VOLTAGE REGULATOR FOR SOLAR CELL ARRAYS

BACKGROUND OF THE INVENTION

This invention relates generally to voltage regulators and, more particularly, to voltage regulators used for controlling large solar cell arrays.

Solar cell arrays are widely used in providing power for spacecraft. The individual photovoltaic cells that make up a solar cell array are typically interconnected in various series and parallel networks to form power segments. The power segments are generally controlled by a voltage regulator in order to provide a constant supply voltage to the spacecraft load. The supply voltage must be regulated because the output voltage of each power segment varies as the amount of current drawn from that power segment varies and because of the inherently non-constant output characteristics of the individual solar cells. These non-constant output characteristics depend, for example, on the angle of disposition of the solar cells toward the radiant energy source, the degree of eclipse of the individual solar cells by spacecraft structures, and the temperature dependence of the solar cells.

Voltage regulators used to control solar cell arrays are typically classified as either a series type or a shunt type voltage regulator, depending upon whether the active element of the regulator is in series with the solar cell array or in parallel with the array. A shunt voltage regulator generally shorts the power segments or dissipates energy from the power segments through resistor or power transistor networks to maintain the supply voltage constant, while the series voltage regulator generally switches the power segments into and out of the output to maintain the supply voltage constant. The series voltage regulator is sometimes preferred because it does not require shorting out the power segments, as does the shunt voltage regulator. However, switch controllers of the prior art, which switch the power segments into and out of the output, frequently do not provide acceptable switching characteristics for the power segments. These switching characteristics include, for example, the number of switches required to control the power segments, the power requirements of each switch, the resolution provided by the switches, and the amount of control logic required to control the switches. Accordingly, there has been a need for an improved switch controller providing improved switching characteristics for the power segments of a solar cell array. The present invention clearly fulfills this need.

SUMMARY OF THE INVENTION

The present invention resides in a novel switch controller and related method for regulating the output of a segmented array, such as the supply voltage of a solar cell array. Briefly, and in general terms, the switch controller of the present invention includes at least two shift registers, with additional shift registers concatenated as required by the size of the array. Each of the shift registers controls segments of the array having increasingly larger outputs, with the first shift register providing fine resolution control of the output of the array and the second and additional shift registers providing increasingly-coarser resolution control of the output. The related method of the present invention involves sequentially switching the shift registers to control the output of the array.

More specifically, in a presently preferred embodiment of the invention, the switch controller of the present invention is used to regulate the supply voltage $V_S$ of a large solar cell array. The solar cell array consists of many individual photovoltaic cells interconnected in a matrix of parallel and series networks within the array, to form a plurality of increasingly-larger power segments. The switch controller regulates the supply voltage $V_S$ by switching the power segments of the array into and out of the output of the solar cell array with three shift registers. The first shift register controls segments of the solar cell array providing power P, the second shift register controls segments providing power $K_1P$, and the third shift register controls segments providing power $K_2K_1P$. The power segments are switched into and out of the output of the array based on an error voltage $V_e$, which is the error between the supply voltage $V_S$ and a reference voltage $V_{REF}$.

The first shift register provides fine resolution control of the supply voltage $V_S$. If the error voltage $V_e$ is positive, the next power segment in sequence providing power P is switched out of the output of the solar cell array by the first shift register on the following clock pulse. If the error voltage $V_e$ is negative, the next segment in sequence providing power P is switched into the output on the following clock pulse. The segments are switched into the output of the array with a shift-right control signal, which causes a one to be entered into the shift register, and switched out of the output with a shift-left control signal, which cause a zero to be entered into the shift register.

When the first shift register contains all ones and a shift-right control signal is present, the next segment in sequence providing power $K_1P$ is switched into the output of the solar cell array by the second shift register on the following clock pulse. When the first shift register contains all zeroes and a shift-left control signal is present, the next segment in sequence providing power $K_1P$ is switched out of the output on the following clock pulse. When the second shift register is shifted left or right, the first shift register is preset with half ones and half zeroes, so that only one increment of power P results from the shift of the second register. This also places the first shift register in the middle of its control range for continued fine resolution control of the supply voltage $V_S$.

When the first and second shift registers contain all ones and a shift-right control signal is present, the next segment in sequence providing power $K_2K_1P$ is switched into the output of the solar cell array by the third shift register on the following clock pulse. When the first and second shift registers contain all zeroes and a shift-left control signal is present, the next segment in sequence providing power $K_2K_1P$ is switched out of the output on the following clock pulse. When the third shift register is shifted left or right, the first and second shift registers are preset with half ones and half zeroes, so that only one increment of power P results from the shift of the third register and to place the first and second shift registers in the middle of their control ranges.

It will be appreciated from the foregoing that the present invention provides improved switching characteristics for the regulation of the supply voltage of a solar cell array. Other features and advantages of the present invention will become apparent from the following more detailed description, taken in conjunction with the accompanying drawings, which illustrate, by way of example, the principles of the invention.

BRIEF DESCRIPTION OF THE DRAWINGS

FIGS. 2A–2E are schematic illustrations of several prior art switch controllers;

DETAILED DESCRIPTION OF THE PREFERRED EMBODIMENTS

Figure 4:
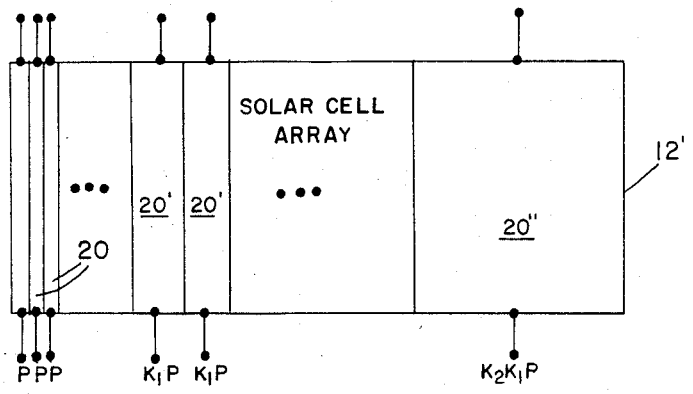
FIG. 4 illustrates a solar cell array for use with the present invention.

As shown in the drawings for purposes of illustration, the present invention is embodied in a novel switch controller and related method for regulating the output of a segmented array, such as the voltage of a large solar cell array. The individual photovoltaic cells that make up a solar cell array are typically interconnected in various series and parallel networks to form power segments. The power segments are controlled by a voltage regulator in order to provide a constant supply voltage to the load. One type of voltage regulator that is sometimes preferred is a series voltage regulator, which uses a switch controller to switch the power segments into and out of the output to maintain the supply voltage constant. However, switch controllers of the prior art frequently do not provide acceptable switching characteristics for the power segments.

In accordance with the present invention, a switch controller includes at least two shift registers, with additional shift registers concatenated as required by the size of the array. Each of the shift registers controls segments of the array having increasingly larger outputs, with the first shift register providing fine resolution control of the output of the array and the second and additional shift registers providing increasingly-coarser resolution control of the output. The related method of the present invention involves sequentially switching the shift registers to control the output of the array.

Figure 1:
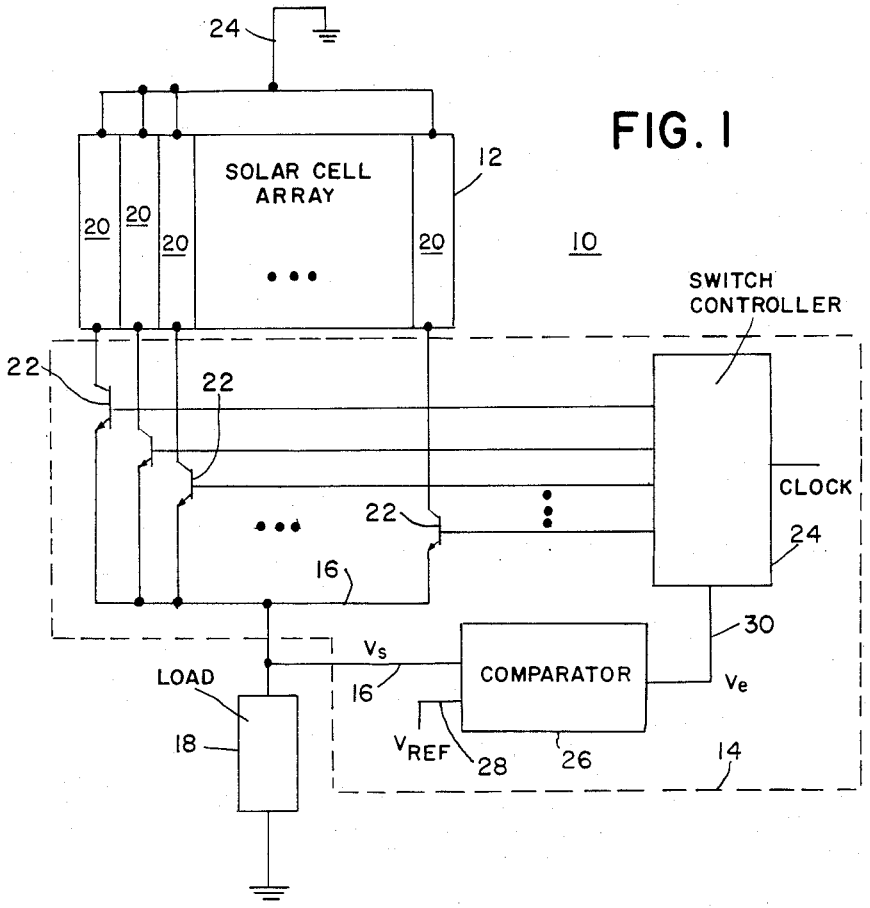
FIG. 1 is a schematic illustration of a solar cell power generator system.

FIG. 1 illustrates a solar cell power generator system 10 for generating power to be used, for example, on board a spacecraft. The power generator system 10 includes a large solar cell array 12 and a voltage regulator 14. The solar cell array 12 generates a supply voltage $V_S$, on line 16, and the voltage regulator 14 maintains the supply voltage $V_S$ constant across a load 18. The large solar cell array 12 consists of many individual photovoltaic cells interconnected in a matrix of parallel and series networks within the array, to form a plurality of equal-sized power segments 20 providing power P. The positive terminals of the power segments 20 are connected to line 16 through transistor switches 22 and the negative terminals of the power segments 20 are connected to ground by line 24. The load 18 can be, for example, a resistive load or a constant power load.

The supply voltage $V_S$ on line 16 is regulated by switching the power segments 20 of the array 12 into and out of the output of the power generator system 10 with the transistor switches 22. The output voltage provided by each segment varies as the current drawn from that segment varies, decreasing as the current increases and increasing as the current decreases. Therefore, as the load 18 draws more current, additional segments must be switched into the output and as the load 18 draws less current, segments must be switched out of the output to maintain the supply voltage $V_S$ constant.

The transistor switches 22 are controlled by a switch controller 24, which, in turn, is controlled by a comparator 26. The comparator 26 generates an error between the supply voltage $V_S$ on line 16 and a reference voltage $V_{REF}$, on line 28. The output of the comparator 26 is an error voltage $V_e$, on line 30. If the error voltage $V_e$ is positive, the next segment 20 in sequence is switched out of the output of the power generator system 10 by the switch controller 24 on the following clock pulse. If the error voltage $V_e$ is negative, the next segment 20 in sequence is switched into the output on the following clock pulse. The result is a limit-cycle or ripple of the supply voltage $V_S$ about the reference voltage $V_{REF}$.

FIGS. 2A–2E illustrate several prior art switch controllers 24. FIG. 2A illustrates a series-sequenced controller, which performs the type of switching discussed above. The series-sequenced controller employs a shift register 32 to sequentially switch the equal-sized power segments, providing power P, into and out of the output of the power generator system 10. This type of switch controller, disclosed in U.S. Pat. No. 3,487,229 to Krausz, is simple to implement, is easily evaluated for stability of its feedback loop, and requires a minimum amount of control logic. However, a large number of switches is required for fine resolution control of the supply voltage $V_S$.

FIG. 2B illustrates a binary-count controller utilizing a binary counter 34 to sequentially switch binary-weighted array segments, providing power $2^{N-1}P$ (where N=1, 2, 3 . . . ), into and out of the output of the power generator system 10. This type of switch controller requires fewer switches than the series-sequenced controller and has some of the same advantages. However, the larger sized segments require very large switches and, because each segment of the array has a different power output, special design considerations are required. Furthermore, binary counters present problems at the higher binary counts, where too many bits can change state all at once. For example, all the bits can change state, from 01111111 to 10000000, for just a single increment of power P, or from 10000000 to 01111111, for just a single decrement of power P. This can cause large sections of the solar cell array to oscillate between the on and off positions for just a single increment or decrement of power.

FIG. 2C illustrates a binary-count, series-sequenced controller employing a binary counter 36 in combination with a shift register 38 to sequentially switch binary-weighted array segments, providing power $2^{N-1}P$ (where N=1, 2, 3 . . . ), and equal-sized array segments, providing power $(2^K-1)P$ (where K equals the N of the highest binary-weighted array segment), int and out of the output of the power generator system 10. The binary counter 36 provides fine resolution control of the output and the shift register 38 provides coarse resolution control of the output. This combination of the two types of controllers results in a much improved switch controller, but requires slightly more control logic.

FIG. 2D illustrates a linear, series-sequenced controller utilizing a small, linear shunt regulator 40 in combination with a shift register 42. The shift register 42 sequentially switches equal-sized array segments, providing power P, into and out of the output of the power generator system 10 and the linear regulator 40 provides fine, linear control up to the power P of each array segment. The linear regulator 40 reduces the switching frequency required by the shift register 42 for fine resolution control of the output. However, the analog regulator dissipates more power than a digital regulator and evaluation of the stability of the feedback loop is more complex.

FIG. 2E illustrates a direct address controller employing a microprocessor 44 and a demultiplexer 46. This type of controller can be easily adapted to varying spacecraft conditions and allows several switches to be addressed simultaneously, thus reducing transient response time. However, the microprocessor 44 is quite complex and evaluation of the stability of the feedback loop is the most complex of all the switch controllers.

Figure 3:
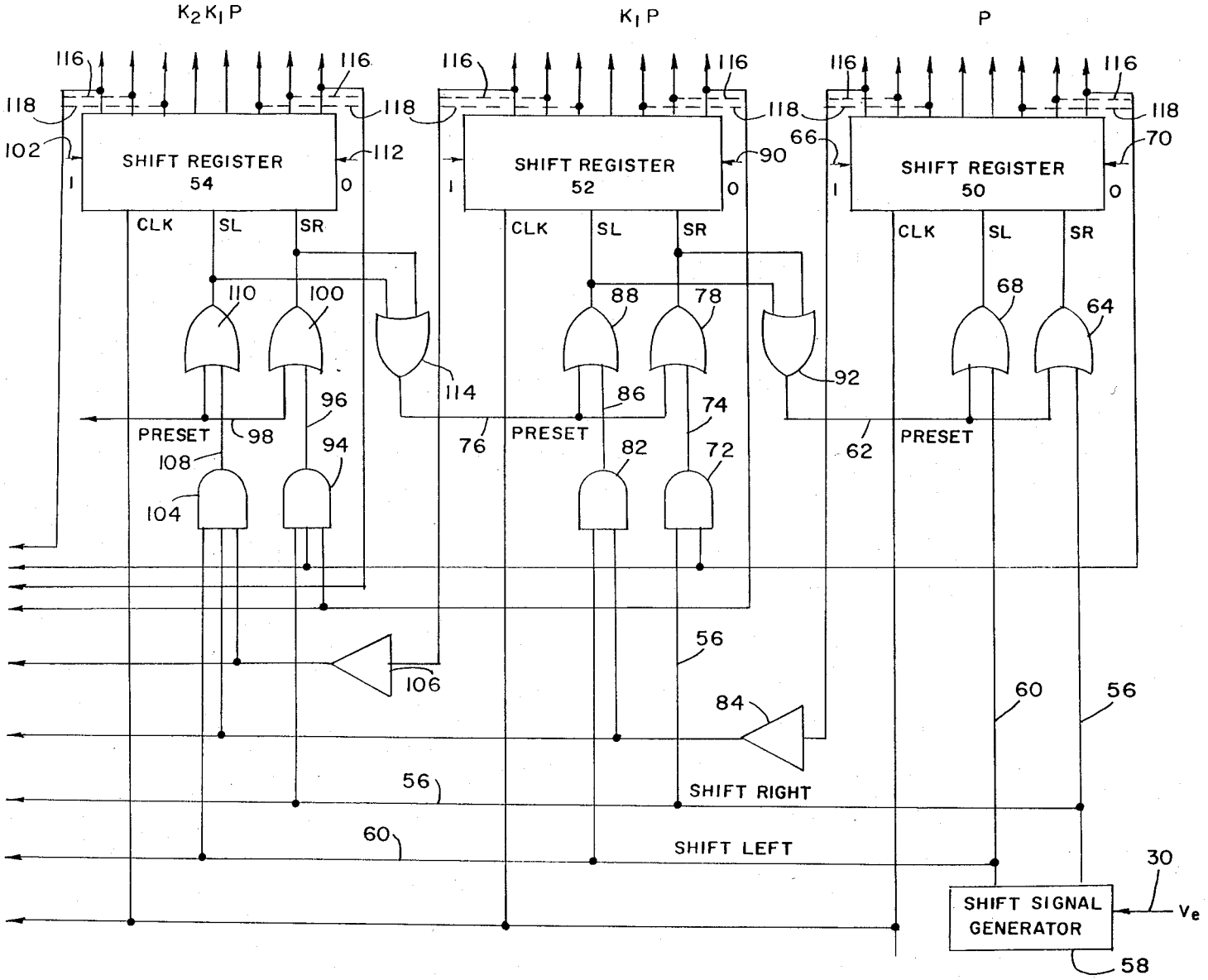
FIG. 3 is a schematic illustration of the switch controller of the present invention.

FIG. 3 illustrates a presently preferred embodiment of the switch controller 24 of the present invention. The switch controller 24 includes at least two shift registers 50, 52, with additional shift registers, such as shift register 54, concatenated as required by the size of the solar cell array. As shown in FIGS. 3 and 4, each of the shift registers controls increasingly larger-sized segments of solar cell array 12'. Shift register 50 controls segments 20 providing power P, shift register 52 controls segments 20' providing power $K_1P$, and shift register 54 controls segments 20'' providing power $K_2K_1P$. In the presently preferred embodiment of the invention, the gain factor $K_1$ is one plus one-half the number of segments controlled by shift register 50 and $K_2$ is one plus one-half the number of segments controlled by shift register 52. Therefore, with eight segments of solar cell array 12' controlled by each of the shift registers 50, 52, as shown in FIG. 3, $K_1$ and $K_2$ are both five $(1+(8/2))$.

Each of the shift registers 50, 52, 54 is preferably an off-the-shelf, eight-bit shift register having eight parallel outputs, shift-left and shiftright serial inputs, eight parallel inputs, shiftleft and shift-right control inputs, and a clock input. On each clock pulse, with the shift-right control input high, the shift register shifts right the eight parallel outputs. The shift-right serial input provides the new left-most output, while the old right-most output is dropped. Similarly, on each clock pulse, with the shift-left control input high, the shift register shifts left the eight parallel outputs. The shift-left serial input provides the new right-most output, while the old left-most output is dropped. On each clock pulse, with both shift-left and shift-right control inputs high, the shift register is loaded with its eight parallel inputs. On each clock pulse, with both shift-left and shift-right control inputs low, the shift register maintains its present state.

Shift register 50 provides fine resolution control of the supply voltage $V_S$. If the error voltage $V_e$ on line 30 is positive, the next segment 20 in sequence is switched out of the output of the power generator system 10 by shift register 50 on the following clock pulse. If the error voltage $V_e$ is negative, the next segment in sequence is switched into the output on the following clock pulse. The segments 20 are switched into and out of the output with a shift right and a shift left, respectively, of shift register 50.

When the error voltage $V_e$ on line 30 is positive, a shift-right control signal is generated, on line 56, by a shift control signal generator 58. When the error voltage $V_e$ is negative, a shift-left control signal is generated, on line 60, by the shift control signal generator 58. The shift-right control signal on line 56, which is ORed with a preset signal on line 62 by OR gate 64, causes a one to be entered into shift register 50 from a shift-right serial input, on line 66, on the following clock pulse. The shift-left control signal on line 60, which is ORed with the preset signal on line 62 by OR gate 68, causes a zero to be entered into shift register 50 from a shift-left serial input, on line 70, on the following clock pulse. A one at the output of shift register 50 turns on its switch transistor 22 (FIG. 1), adding a segment 20 providing power P to the output of the power generator system 10. A zero at the output of shift register 50 turns off its switch transistor 22, removing a segment 20 from the output.

When shift register 50 contains all ones and a shift-right control signal on line 56 is present, the next segment 20' in sequence providing power $K_1P$ is switched into the output of the power generator system 10 on the following clock pulse. Shift register 50 contains all ones when the right-most output of the shift register is a one. AND gate 72 ANDs the right-most output of shift register 50 and the shift-right control signal on line 56 to generate a shift-right control signal, on line 74, when both of its inputs are ones. The shift-right control signal on line 74, which is ORed with a preset signal on line 76 by OR gate 78, causes a one to be entered into shift register 52 from a shift-right serial input, on line 80, on the following clock pulse. A one at the output of shift register 52 turns on its switch transistor 22 (FIG. 1), adding segment 20' providing power $K_1P$ to the output of the power generator system 10.

When shift register 50 contains all zeroes and a shift-left control signal on line 60 is present, the next segment 20' in sequence is switched out of the output on the following clock pulse. Shift register 50 contains all zeroes when the left-most output of the shift register is a zero. AND gate 82 ANDs the left-most output of shift register 50, after being inverted by inverter 84, and the shift-left control signal on line 60 to generate a shift-left control signal, on line 86, when both of its inputs are ones. The shift-left control signal on line 86, which is ORed with the preset signal on line 76 by OR gate 88, causes a zero to be entered into shift register 52 from a shift-left serial input, on line 90, on the following clock pulse. A zero at the output of shift register 52 turns off its switch transistor 22 (FIG. 1), removing a segment 20' from the output of the power generator system 10.

When shift register 52 is shifted left or right to switch a segment 20' into or out of the output of the power generator system 10, shift register 50 must be preset with half ones and half zeroes, so that only one increment of power P results from the shift of register 52. This also places shift register 50 in the middle of its control range for continued fine resolution control of the supply voltage $V_S$. Shift register 50 is preset by the preset signal on line 62, which is generated when OR gate 92 outputs a one. OR gate 92 outputs a one when the shift-right control signal on line 74, the shift-left control signal on line 86, or the preset signal on line 76 is generated. The preset signal on line 62 is ORed with the shift-right control signal on line 56 and the shift-left control signal on line 60 by OR gates 64 and 68, respectively. When OR gates 64, 68 both output a one, shift register 50 is loaded with its parallel inputs of half ones and half zeroes, or 11110000.

When both shift registers 50, 52 contain all ones and a shift-right control signal on line 56 is present, the next segment 20'' in sequence providing power $K_2K_1P$ is switched into the output of the power generator system 10 on the following clock pulse. Shift registers 50, 52 contain all ones when the right-most outputs of the two shift registers are ones. AND gate 94 ANDs the right-most outputs of shift registers 50, 52 and the shift-right control signal on line 56 to generate a shift-right control signal, on line 96, when all of its inputs are ones. The shift-right control signal on line 96, which is ORed with a preset signal on line 98 by OR gate 100, causes a one to be entered into shift register 54 from a shift-right serial input, on line 102, on the following clock pulse. A one at the output of shift register 54 turns on its switch transistor 22 (FIG. 1), adding a segment 20'' providing power $K_2K_1P$ to the output of the power generator system 10.

When shift registers 50, 52 contain all zeroes and a shift-left control signal on line 60 is present, the next segment 20'' in sequence is switched out of the output on the following clock pulse. Shift registers 50, 52 contain all zeroes when the left-most outputs of the two shift registers are zeroes. AND gate 104 ANDs the left-most outputs of shift registers 50, 52, after being inverted by inverters 84, 106, respectively, and the shift-left control signal on line 60 to generate a shift-left control signal, on line 108, when all of its inputs are ones. The shift-left control signal on line 108, which is ORed with the preset signal on line 98 by OR gate 110, causes a zero to be entered into shift register 54 from a shift-left serial input, on line 112. A zero at the output of shift register 54 turns off its switch transistor 22 (FIG. 1), removing a segment 20'' from the output of the power generator system 10.

When shift register 54 is shifted left or right to switch a segment 20'' into or out of the output of the power generator system 10, shift registers 50, 52 must be preset with half ones and half zeroes, so that only one increment of power P results from the shift of register 54. This also places shift registers 50, 52 in the middle of their control ranges. Shift registers 50, 52 are preset by the preset signal on line 76, which is generated when OR gate 114 outputs a one. OR gate 114 outputs a one when the shift-right control signal on line 96, the shift-left control signal on line 108, or the preset signal on line 98 is generated. The preset signal on line 76 is ORed with the shift-right control signal on line 74 and the shift-left control signal on line 86 by OR gates 78 and 88, respectively. When OR gates 78, 88 both output a one, shift register 52 is loaded with its parallel inputs of half ones and half zeroes and the preset signal on line 62 is generated, thus loading shift register 50 with its parallel inputs of half ones and half zeroes.

Although only three shift registers are illustrated in FIG. 3, additional shift registers controlling power segments with even higher gain factors can be concatenated as required by the size of the solar cell array 12'. In addition, the gain factors can be easily varied by modifying the number of segments that each shift register controls. As will be recalled, the gain factor of a shift register is one plus one-half the number of segments controlled by the next lower shift register. For example, dashed lines 116, connected to the second and seventh outputs of the shift registers, illustrate the appropriate connections for changing the gain factor of the next lower shift register to four. Similarly, dashed lines 118, connected to the third and sixth outputs of the shift registers, illustrate the appropriate connections for changing the gain factor of the next lower shift register to three. The gain factors can also be increased by increasing the number of outputs of the next lower shift register.

In the presently preferred embodiment of the invention, the shift registers are preset with half ones and half zeroes. Consequently, the gain factor of a shift register is one plus one-half the number of segments controlled by the next lower shift register. Although presetting a shift register with half ones and half zeroes puts the shift register in the middle of its control range and provides a maximum gain factor, the shift registers can be preset with any ratio of ones to zeroes (except all ones or all zeroes). The gain factor of a shift register is then one plus the number of segments that are switched when the next lower register is preset. For example, if a shift register contains all ones and is preset with two zeroes and six ones when a one is shifted into the next upper shift register, two segments are switched by the preset (from ones to zeroes). When the same shift register contains all zeroes and a zero is shifted into the next upper shift register, the shift register is preset with two ones and six zeroes and again two segments are switched by the preset (from zeroes to ones). Therefore, the gain factor of the next upper shift register in this example is three (1+2).

From the foregoing, it will be appreciated that the present invention provides regulation of the supply voltage of a solar cell array with as fine a resolution as a series-sequenced controller, but with fewer switches (reduced by a number equal to the gain factors), little control logic, and without the oscillation problems of a binary-count controller. Although several preferred embodiments of the invention have been shown and described, it will be apparent that other adaptations and modifications can be made without departing from the spirit and scope of the invention. For example, the present invention can be easily adapted for direct control of the higher-gain shift registers when large voltage errors are encountered, rather than waiting for these large changes to ripple through the system from the lower-gain shift registers. The present invention can also be easily adapted to a shunt type voltage regulator or to any type of power generation system that utilizes arrays of single elements, such as thermoelectric or electrochemical cells. The present invention can also be easily adapted for control of any output where that output results from the combination of several inputs. Accordingly, the invention is not to be limited, except as by the following claims.

I claim:

1. A switch controller for regulating the output of a segmented array, comprising:

means for switching a first plurality of segments of the array into and out of the output of the array, each of the first plurality of segments generating an output of a first magnitude for fine resolution control of the output; and means for switching a second plurality of segments of the array into and out of the output of the array, each of the second plurality of segments generating an output of a second magnitude, the second magnitude being greater than the first magnitude for coarse resolution control of the output.

2. The switch controller as set forth in claim 1, and further including:

means for switching a third plurality of segments of the array into and out of the output of the array, each of the third plurality of segments generating an output of a third magnitude, the third magnitude being greater than the second magnitude for coarser resolution control of the output.

3. The switch controller as set forth in claim 2, wherein each of the means for switching includes a shift register.

4. The switch controller as set forth in claim 2, wherein the segmented array is a solar cell array and the output of the array is voltage.

5. A method for regulating the output of a segmented array, comprising the steps of:

sequentially switching a first plurality of segments of the array into and out of the output of the array, each of the first plurality of segments generating an output of a first magnitude for fine resolution control of the output; and sequentially switching a second plurality of segments of the array into and out of the output of the array, each of the second plurality of segments generating an output of a second magnitude, the second magnitude being greater than the first magnitude for coarse resolution control of the output.

6. The regulating method as set forth in claim 5, and further including the steps of:

sequentially switching a third plurality of segments of the array into and out of the output of the array, each of the third plurality of segments generating an output of a third magnitude, the third magnitude being greater than the second magnitude for coarser resolution control of the output.

7. The regulating method as set forth in claim 6, wherein the segmented array is a solar cell array and the output of the array is voltage.

8. A switch controller for regulating the output of a segmented array, comprising:

means for computing an error between the output of the segmented array and a reference output;

means for switching a first plurality of segments of the array into and out of the output of the array, each of the first plurality of segments generating an output of a first magnitude for fine resolution control of the output; and means for switching a second plurality of segments of the array into and out of the output of the array, each of the second plurality of segments generating an output of a second magnitude, the second magnitude being greater than the first magnitude for coarse resolution control of the output;

wherein the first plurality of segments of the array are switched sequentially into the output of the array when the error is positive and out of the output when the error is negative;

and wherein the second plurality of segments of the array are switched sequentially into the output of the array when all of the first plurality of segments are switched into the output and the error is positive and out of the output of the array when all of the first plurality of segments are switched out of the output and the error is negative;

thereby regulating the output of the array to approximately the reference output.

9. The switch controller as set forth in claim 8, and further including:

means for switching a third plurality of segments of the array into and out of the output of the array, each of the third plurality of segments generating an output of a third magnitude, the third magnitude being greater than the second magnitude for coarser resolution control of the output;

wherein the third plurality of segments of the array are switched sequentially into the output of the array when all of the first and second plurality of segments are switched into the output and the error is positive and out of the output of the array when all of the first and second plurality of segments are switched out of the output and the error is negative.

10. The switch controller as set forth in claim 8, wherein the first plurality of segments of the array are switched half into and half out of the output of the array when a segment of the second plurality of segments is switched into or out of the output, and wherein the second magnitude is approximately equal to the first magnitude multiplied by one plus one-half the number of segments in the first plurality of segments.

11. The switch controller as set forth in claim 9, wherein the first and second plurality of segments of the array are switched half into and half out of the output of the array when a segment of the third plurality of segments is switched into or out of the output, and wherein the third magnitude is approximately equal to the second magnitude multiplied by one plus one-half the number of segments in the second plurality of segments.

12. The switch controller as set forth in claim 9, wherein each of the means for switching includes a shift register.

13. The switch controller as set forth in claim 11, wherein the number of segments is eight, the second magnitude is approximately five times the first magnitude, and the third magnitude is approximately five times the second magnitude.

14. The switch controller as set forth in claim 9, wherein the segmented array is a solar cell array and the output of the array is voltage.

15. A method for regulating the output of a segmented array, comprising the steps of:

computing an error between the output of the segmented array and a reference output;

sequentially switching a first plurality of segments of the array into the output of the array when the error is positive and out of the output when the error is negative, each of the first plurality of segments generating an output of a first magnitude for fine resolution control of the output; and sequentially switching a second plurality of segments of the array into the output of the array when all of the first plurality of segments are switched into the output and the error is positive and out of the output of the array when all of the first plurality of segments are switched out of the output and the error is negative, each of the second plurality of segments generating an output of a second magnitude, the second magnitude being greater than the first magnitude for coarse resolution control of the output;

thereby regulating the output of the array to approximately the reference output.

16. The regulating method as set forth in claim 15, and further including the steps of:

sequentially switching a third plurality of segments of the array into the output of the array when all of the first and second plurality of segments are switched into the output and the error is positive and out of the output of the array when all of the first and second plurality of segments are switched out of the output and the error is negative, each of the third plurality of segments generating an output of a third magnitude, the third magnitude being greater than the second magnitude for coarser resolution control of the output.

17. The regulating method as set forth in claim 15, and further including the steps of:

switching the first plurality of segments of the array half into and half out of the output of the array when a segment of the second plurality of segments is switched into or out of the output;

wherein the second magnitude is approximately equal to the first magnitude multiplied by one plus one-half the number of segments in the first plurality of segments.

18. The regulating method as set forth in claim 16, and further including the steps of:

switching the first and second plurality of segments of the array half into and half out of the output of the array when a segment of the third plurality of segments is switched into or out of the output;

wherein the third magnitude is approximately equal to the second magnitude multiplied by one plus one-half the number of segments in the second plurality of segments.

19. The regulating method as set forth in claim 18, wherein the number of segments is eight, the second magnitude is approximately five times the first magnitude, and the third magnitude is approximately five times the second magnitude.

20. The regulating method as set forth in claim 16, wherein the segmented array is a solar cell array and the output of the array is voltage.

21. A switch controller for regulating the output of a segmented array, comprising:

means for computing an error between the output of the segmented array and a reference output;

a first shift register for sequentially switching a first plurality of segments of the array into the output of the array when the error is positive and out of the output when the error is negative, each of the first plurality of segments generating an output of a first magnitude for fine resolution control of the output;

a second shift register for switching a second plurality of segments of the array into and out of the output of the array, each of the second plurality of segments generating an output of a second magnitude, the second magnitude being approximately equal to the first magnitude multiplied by one plus one-half the number of segments in the first plurality of segments;

a first plurality of logic gates for shifting right the second shift register to sequentially switch the second plurality of segments of the array into the output o the array when all of the first plurality of segments are switched into the output and the error is positive;

a second plurality of logic gates for shifting left the second shift register to sequentially switch the second plurality of segments of the array out of the output of the array when all of the first plurality of segments are switched out of the output and the error is negative; and an OR gate for loading the first shift register with parallel inputs of half ones and half zeroes to switch the first plurality of segments of the array half into and half out of the output of the array when a segment of the second plurality of segments is switched into or out of the output;

thereby regulating the output of the array to approximately the reference output.

22. The switch controller as set forth in claim 21, and further including:

a third shift register for switching a third plurality of segments of the array into and out of the output of the array, each of the third plurality of segments generating an output of a third magnitude, the third magnitude being approximately equal to the second magnitude multiplied by one plus one-half the number of segments in the second plurality of segments;

a third plurality of logic gates for shifting right the third shift register to sequentially switch the third plurality of segments of the array into the output of the array when all of the first and second plurality of segments are switched into the output and the error is positive;

a fourth plurality of logic gates for shifting left the third shift register to sequentially switch the third plurality of segments of the array out of the output of the array when all of the first and second plurality of segments are switched out of the output and the error is negative; and an OR gate for loading the second shift register with parallel inputs of half ones and half zeroes to switch the second plurality of segments of the array half into and half out of the output of the array when a segment of the third plurality of segments is switched into or out of the output.

23. The switch controller as set forth in claim 22, wherein the number of segments is eight, the second magnitude is approximately five times the first magnitude, and the third magnitude is approximately five times the second magnitude.

24. The switch controller as set forth in claim 22, wherein the segmented array is a solar cell array and the output of the array is voltage.

* * * * *